62-174 SR

10/15/85 OR 4,546,616

United States Patent [19]

Drucker

[11] Patent Number: 4,546,616

[45] Date of Patent: Oct. 15, 1985

[54] HEAT PUMP CHARGE OPTIMIZER

[75] Inventor: Alan S. Drucker, Dewitt, N.Y.

[73] Assignee: Carrier Corporation, Syracuse, N.Y.

[21] Appl. No.: 583,516

[22] Filed: Feb. 24, 1984

[51] Int. Cl.[4] ..... F25B 39/04

[52] U.S. Cl. ..... 62/174; 62/509

[58] Field of Search ..... 62/160, 174, 149, 509, 62/324.1, 324.4

[56] References Cited

U.S. PATENT DOCUMENTS

| | | | |
|---|---|---|---|
| 2,581,044 | 1/1952 | Ratcliff | 62/149 |
| 2,589,384 | 3/1952 | Hopkins | 62/174 X |
| 2,715,317 | 8/1955 | Rhodes | 62/160 X |
| 2,807,940 | 10/1957 | Urban | 62/149 |
| 3,226,938 | 1/1966 | Hanson | 62/174 |
| 3,301,001 | 1/1967 | McKinney | 62/149 |
| 3,580,005 | 5/1971 | Hale | 62/149 |
| 3,736,763 | 6/1973 | Garland | 62/174 X |

*Primary Examiner*—Harry Tanner
*Attorney, Agent, or Firm*—David J. Zobkiw

[57] ABSTRACT

The optimum charge in the heating and cooling modes is achieved in a reversible heat pump system by providing a receiver in the indoor section which is sized to store an amount of refrigerant equal to the difference in the optimum charge in each mode. The amount of refrigerant in the receiver is varied in response to the ambient temperature whereby the refrigerant charge is optimized over a range of temperatures.

5 Claims, 1 Drawing Figure

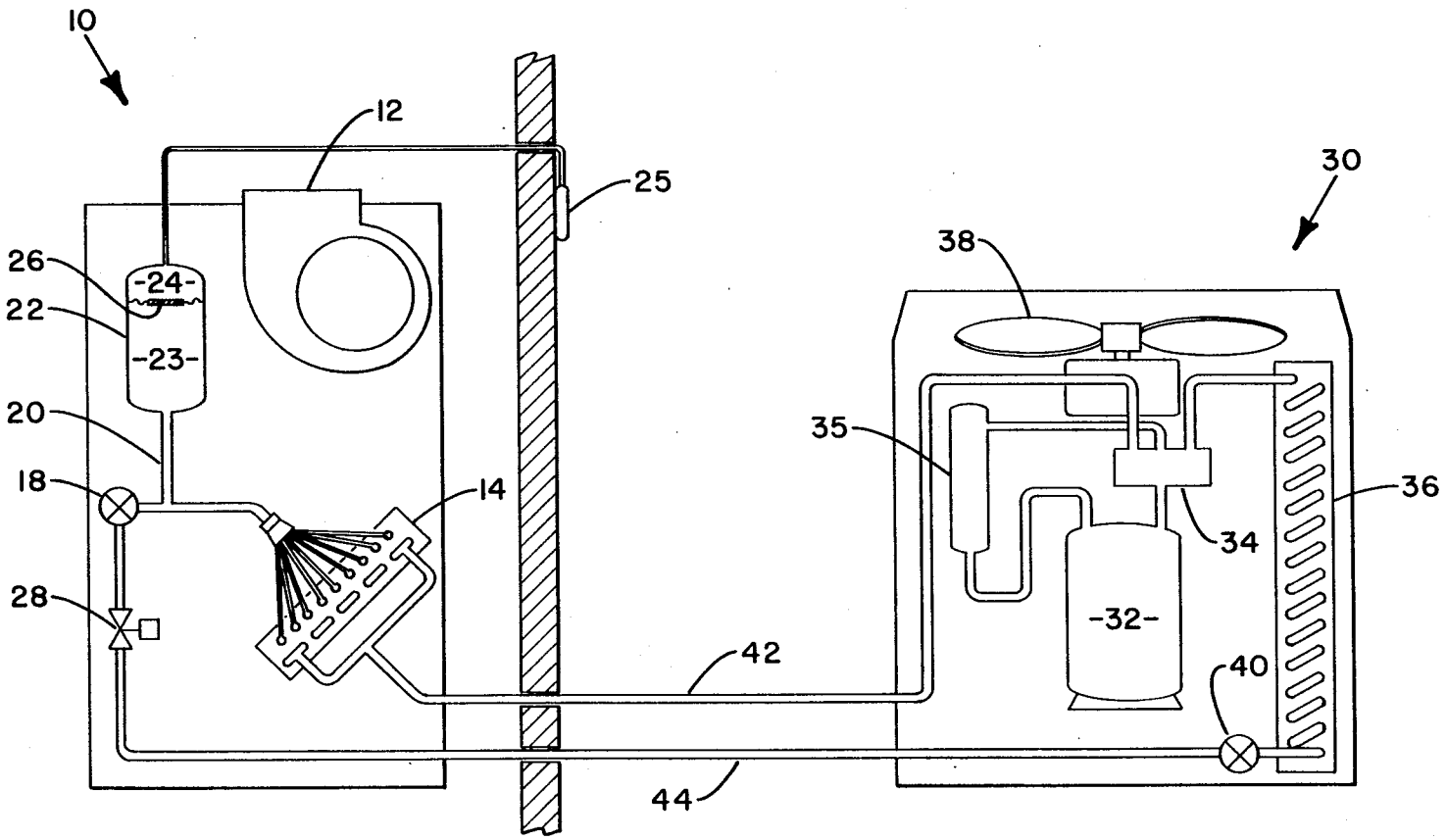
10
12
14
18
20
22
23
24
25
26
28
30
32
34
35
36
38
40
42
44

HEAT PUMP CHARGE OPTIMIZER

BACKGROUND OF THE INVENTION

In a refrigeration or air conditioning system there is an optimum refrigerant charge for each temperature differential between the conditioned space and ambient. When the system is a reversible heat pump system, however, the volume of the liquid and vapor portions of the system can be quite different in the heating and cooling modes. Thus, while a compromise refrigerant charge can be made based upon the anticipated range and duration of ambient temperatures, the degree of compromise can be exacerbated by the different phase volumes in the different modes. The use of a compromised charge causes a decrease in the heating coefficient of performance and excessive temperatures in the cooling mode. To overcome these losses, a receiver is sometimes employed to effectively change the amount of charge in the system. Since a single receiver or receiver connection is used, in the heating mode, the receiver fills with liquid refrigerant which is thereby effectively removed from the circulating system. Similarly, in the cooling mode, the receiver fills with gaseous refrigerant which is thereby effectively removed from the circulating system. Because liquid refrigerant is effectively removed from the system in the heating mode and gaseous refrigerant is effectively removed from the system in the cooling mode, the effective mass of the refrigerant is different for each mode of operation, but the mass removal from cooling mode is not significant.

SUMMARY OF THE INVENTION

In accordance with the present invention, a heat pump system is set up and the optimum charge for cooling is determined at the American Refrigeration Institute (ARI) rating points of 95° and 82° F. ambient. Since these points are used to determine the capacity and power level, respectively, the optimum charge for each point is determined and a compromise charge determined therefrom as the optimum for both points. It is necessary to test the system or to calculate the optimum charge based upon the volumes of the various parts of the complete system since the piping, etc. affects the charge volume. The optimum charge is similarly determined for the heating mode at 47° F. ambient, a standard testing point. The difference in the optimum charges is then determined and this will depend in part upon the piping lengths used, etc. but could be on the order of 5 to 10 pounds. The corresponding volume of the liquid refrigerant is determined for the liquid refrigerant operating temperature. In the heating mode, a second reference temperature is used to rate equipment. The optimum charge is determined for the second standard ambient temperature, 17° F., and the difference from the optimum charge at 47° F. is determined. A receiver divided into two chambers by a diaphragm is provided. The first chamber is in fluid communication with the system and is sized, together with its associated piping and connections, to equal the differential optimal volume between the compromise cooling mode for 95° F. and 82° F. and the heating mode at 47° F. The second chamber is in a closed system which is in fluid communication with a bulb exposed to the ambient and is charged with a gas such that the volume of the second chamber, and thereby the volume of the first chamber is varied responsive to the ambient temperature. As a result the refrigerant charge stored in the receiver is varied in response to ambient temperature and the refrigerant charge is optimized over a range of temperatures. In the heating mode, the refrigerant in the first chamber is in the liquid state. For the cooling mode, however, the first chamber will contain gaseous refrigerant and the varying of the volume of the first chamber will have less effect in varying the effective charge. A solenoid is provided to hold the refrigerant in the receiver and indoor coil within the conditioned space since it has been acted on the system and can be used to further heat/cool the conditioned space.

It is an object of this invention to provide a method and apparatus for optimizing the refrigerant charge of a heat pump.

It is another object of this invention to increase the efficiency of a heat pump system.

It is a further object of this invention to minimize the system degradation coefficient and thereby improve the seasonal efficiency.

It is an additional object of this invention to provide a method and apparatus for optimizing the refrigerant charge of a heat pump responsive to ambient temperature. These objects and others as will become apparent hereinafter, are accomplished by the present invention.

Basically, the effective refrigerant charge is different in the heating and cooling modes to thereby optimize the refrigerant charge. The refrigerant charge is effectively varied by storing a volume of liquid or gaseous refrigerant in a receiver. The amount of refrigerant stored is varied responsive to the ambient temperature whereby the refrigerant charge is optimized over the design operating temperature range. Additionally, the stored volume is retained in the conditioned space when the system is shut down to recover its heating-/cooling value.

BRIEF DESCRIPTION OF THE DRAWING

For a fuller understanding of the present invention, reference should now be made to the following detailed description thereof taken in conjunction with the accompanying drawing wherein:

The FIGURE is a schematic diagram of a reverse cycle heat pump syustem employing the present invention.

DESCRIPTION OF THE PREFERRED EMBODIMENT

In the FIGURE, the numeral 10 designates the indoor section and the numeral 30 designates the outdoor section. A compressor 32 is located in the outdoor section 30 along with a 4-way valve 34, an outdoor coil 36, an outdoor fan 38 and a bypassing/expansion device 40. The indoor section 10 contains an indoor fan 12 and an indoor coil 14 which is directly connected to 4-way valve 34 via line 42 and is connected to outdoor coil 36 via bypassing/expansion device 18 and line 44.

As is conventional, in the heating cycle, hot gaseous refrigerant is discharged from compressor 32 to 4-way valve 34 which directs the hot gaseous refrigerant to indoor coil 14 which is operating as a condenser. The condensed refrigerant passes through bypassing/expansion device 18, which is in the bypass mode, and line 44 to bypassing/expansion device 40, which is in the expansion mode, whereby the condensed refrigerant is expanded and supplied to outdoor coil 36, which is operating as an evaporator. The refrigerant passes from coil 36 via 4-way valve 34 and accumulator 35 to the suction line of compressor 32. In the cooling cycle, hot gaseous refrigerant is discharged from compressor 32 to 4-way value 34 which directs the hot gaseous refrigerant to outdoor coil 36 where the refrigerant condensesw and passes through bypassing/expansion device 40, which is in the bypass mode. The refrigerant then passes through line 44 to indoor section 10 where the refrigerant passes through bypassing/expansion device 18 which is in the expansion mode whereby the refrigerant is expanded and supplied to indoor coil 14, which is acting as an evaporator. The refrigerant is then supplied via line 42, 4-way value 34 and accumulator 35 to the suction line of compressor 32.

Because the optimum refrigerant charge is different in the heating and cooling modes, the optimum charge can be determined for each mode by actual testing or by calculation for an ambient temperature of 95° and 82° F. in the cooling mode, and 47° F. and 17° F. in the heating mode. The difference in the compromise charge for the cooling mode at 95° and 82° F. ambient and for the heating mode at 47° F. ambient is determined. The volume of this difference in the optimum charge is determined for the operating refrigerant temperature. A receiver 22 and line 20 are connected intermediate bypassing/expansion device 18 and indoor coil 14. The receiver 22 is divided into two chambers, 23 and 24, by diaphragm 26. Chambers 23 and line 20 are sized to have a combined volume equal to the difference in the liquid volume for the charge in the heating mode at 47° F. and cooling mode. Alternatively, and more accurately, they may be sized to have a combined volume equal to the difference in the liquid volume for the charge in the heating mode at 47° F. and cooling mode plus the liquid volume equivalent of a refrigerant gas volume equal to the difference in the liquid charge volumes in the heating mode at 47° F. and cooling mode. This correction accounts for the effective removal of gaseous refrigerant due to the filing of receiver 22 in the cooling mode. Chamber 24 is in a closed system which is in fluid communication with bulb 25 which is located so as to be exposed to ambient conditions. Bulb 25 and chamber 24 are charged with a gas such that the volume of chamber 24, and thereby the volume of chamber 23, is varied responsive to the ambient temperature. The volume of chamber 23 is so varied in this manner that the effective refrigerant charge remains optimized over a range of ambient temperatures. A solenoid valve 28 is located in line 44, within indoor section 10 and on the outdoor coil side of bypassing/expansion device 18. Solenoid valve 28 is open when the compressor 32 is running but otherwise is closed.

The operation of the heating and cooling cycles is essentially as described above. However, chamber 23 of receiver 22 and pipe 20 act to effectively remove the refrigerant therein from the system. In the heating cycle chamber 23 and pipe 20 fill with hot liquid refrigerant while in the cooling cycle they fill with cool gaseous refrigerant. Since the refrigerant in the chamber 23 and in pipe 20 is effectively removed from the system, the effective refrigerant charge changes between the heating and cooling modes to optimize the charge in each mode. Further, because the refrigerant charge is additionally varied responsive to ambient temperature the effective refrigerant charge is optimized over a range of temperatures in a mode of operation. Because work has been done to heat or cool the refrigerant in chamber 23, solenoid 28 is provided in line 44 to prevent the draining of charge from indoor coil 14 and chamber 23 when the system is shut down thereby preserving the heating-/cooling value of the trapped refrigerant in the space to be conditioned.

Although a preferred embodiment of the present invention has been illustrated and described, other changes will occur to those skilled in the art. For example, a second receiver can be provided to regulate and thereby optimize the charge over the cooling range. In such a case the charge will be controlled by a different receiver in each mode with the other receiver disabled as by placing solenoid valve 28 in line 20 and closing solenoid valve 28 when the system was in the cooling mode and opening the corresponding valve to the other receiver and vice versa in the heating mode. It is therefore intended that the scope of the present invention is to be limited only by the scope of the appended claims.

What is claimed is:

1. A method of charge optimization in a heat pump system including the steps of:

determining the optimum refrigerant charge in the colling mode for a predetermined ambient temperature range;

determining the optimum refrigerant charge in the heating mode at a predetermined ambient temperature;

determining the difference in the determined optimum charges for the cooling and heating modes;

providing a receiver with a variable storage volume which is sized to store an amount of refrigerant equal to the difference such that the refrigerant charge is varied between the heating and cooling modes;

locating the receiver in the indoor section of the heat pump system such that the receiver is filled with liquid refrigerant in the heating cycle and gaseous refrigerant in the cooling cycle; and varying the amount of refrigerant in the receiver responsive to ambient temperature whereby the refrigerant charge is optimized in each mode.

2. The method of claim 1 further including the step of holding the refrigerant charge within the receiver when the heat pump system is shut down.

3. In a reversible heat pump system:

an outdoor section including an outdoor coil, valve means, compressor means and first fluid communication means providing fluid communication therebetween;

an indoor section including an indoor coil, bypassing-/expansion means and second fluid communication means providing fluid communication therebetween;

third fluid communication means providing fluid communication between said valve means and said indoor coil;

fourth fluid communication means providing fluid communication between said bypassing/expansion means and said outdoor coil;

refrigerant in said first, second, third and fourth fluid communication means;

variable volume receiver means sized to hold a variable volume of liquid refrigerant charge corresponding to the difference in optimum refrigerant charge for the cooling and heating modes of said reversible heat pump system and in fluid communication with said second fluid communication means whereby said variable volume of said receiver means fills with liquid refrigerant when said heat pump system is in the heating mode and fills with gaseous refrigerant when said heat pump system is in the cooling mode to thereby effectively vary the refrigerant charge; and means for varying said variable volume in response to the ambient temperature.

4. The reversible heat pump system of claim 3 further including valve means in said fourth fluid communication means operative to prevent refrigerant to flow from said receiver means when said heat pump system is shut down.

5. The reversible heat pump system of claim 3 wherein said variable volume receiver means includes a movable diaphragm dividing said receiver means into two chambers.

* * * * *

UNITED STATES PATENT AND TRADEMARK OFFICE

CERTIFICATE OF CORRECTION

PATENT NO. : 4,546,616

DATED : October 15, 1985

INVENTOR(S) : Alan S. Drucker

It is certified that error appears in the above-identified patent and that said Letters Patent are hereby corrected as shown below:

In claim 1, at line 4, change "colling" to --cooling--.

Signed and Sealed this

*Fourteenth* Day of *January 1986*

[SEAL]

*Attest:*

*Attesting Officer*

DONALD J. QUIGG

*Commissioner of Patents and Trademarks*